United States Patent [19]

Butler et al.

[11] 4,006,382

[45] Feb. 1, 1977

[54] MAGNETRON FILTER

[75] Inventors: John R. Butler, Lexington; Patricia M. Scott, Medford, both of Mass.

[73] Assignee: Raytheon Company, Lexington, Mass.

[22] Filed: Sept. 24, 1975

[21] Appl. No.: 616,225

[52] U.S. Cl. ..... 315/39.53; 315/39.51; 331/91; 333/79

[51] Int. Cl.[2] ..... H01J 25/50

[58] Field of Search ..... 315/39.53, 39.51; 331/86, 91; 333/79

[56] References Cited

UNITED STATES PATENTS

| | | | |
|---|---|---|---|
| 3,223,881 | 12/1965 | Krug, Jr. | 315/39.53 X |
| 3,334,266 | 8/1967 | Frutiger | 315/39.53 |
| 3,377,562 | 4/1968 | Staats | 315/39.53 X |
| 3,418,522 | 12/1968 | Cook | 331/91 X |
| 3,510,724 | 5/1970 | Staats | 315/39.53 X |
| 3,846,667 | 11/1974 | Hisada et al. | 315/39.53 |
| 3,849,737 | 11/1974 | Oguro | 315/39.53 |
| 3,859,558 | 1/1975 | Harada et al. | 315/39.53 |

*Primary Examiner*—Saxfield Chatmon, Jr.
*Attorney, Agent, or Firm*—Edgar O. Rost; Joseph D. Pannone; Milton D. Bartlett

[57] ABSTRACT

A harmonic frequency suppressor is disclosed for microwave magnetrons having an output antenna probe member. A coaxial cylindrical member is disposed within the vacuum envelope to provide in combination with the antenna probe member a line filter for suppressing harmonic frequencies of the generated output signal frequency. The length of the coaxial member is dimensioned to suppress the desired harmonic frequency.

4 Claims, 2 Drawing Figures

MAGNETRON FILTER

BACKGROUND OF THE INVENTION

1. Field of the Invention

The invention relates to magnetrons and, more particularly, to filters for suppressing harmonic frequencies of the output frequency.

2. Description of the Prior Art

An electromagnetic energy generator widely used in the microwave field particularly in microwave ovens is the magnetron. Mutually perpendicular electric and magnetic fields extend within an interaction region defined between a central cathode and an anode member having a plurality of circumferentially disposed cavity resonators defined by vane members. Alternate resonators are coupled together by strapping between the vane members. The electric fields extend transverse to the axis of the anode member and the magnetic fields extend parallel to the anode axis. Electrons emitted from the heated cathode are accelerated toward the anode cavity resonators and rotate in a substantially circular orbital path to form a rotating spoke-like space charge. The electrons interact in energyexchanging relationship with the electric fields in the cavity resonators to generate extremely high frequency energy oscillations.

The frequencies are in the microwave portion of the electromagnetic energy spectrum which is defined as having wavelengths in the order of from one meter to one millimeter and frequencies in excess of 300 MHz. The frequencies for microwave heating are regulated by the Federal Communications Commission with allotted frequencies at 915 ± 13 MHz and 2450 ± 50 MHz. The energy is coupled from the magnetron by means of output members comprising antenna probes having one end secured to an anode member vane member. The output antenna member is housed within a dielectric dome which is part of the overall evacuated tube envelope.

During operation of microwave heating apparatus the problem with the generation of harmonic frequencies is a continuing one which must be handled. Presently, waveguide filters as well as door seal suppression structures are utilized to attenuate these spurious output signals. The need continues, however, for new and improved means for suppression of the undesired harmonic frequencies of the fundamental frequency generated by a magnetron.

SUMMARY OF THE INVENTION

In accordance with the teachings of the invention, the output structure of a magnetron oscillator tube is provided with a coaxial line filter for suppressing the desired harmonic frequencies. A coaxial conductive cylinder encircles the antenna probe member within the envelope and has a length corresponding to a quarter wavelength at the frequency which is to be suppressed. In the embodiment of the invention, a first cylindrical member is provided to suppress the second harmonic frequencies. In addition, a second coaxial cylinder is provided concentrically disposed within the first cylindrical member having a dimension designed to suppress the third harmonic frequencies. The disclosed structure is housed completely within the evacuated envelope and effective suppression of the undesired frequencies has been noted.

BRIEF DESCRIPTION OF THE DRAWINGS

Details of the invention will be readily understood after consideration of the following description and reference to the accompanying drawings, wherein.

DESCRIPTION OF THE PREFERRED EMBODIMENT

Figure 1:
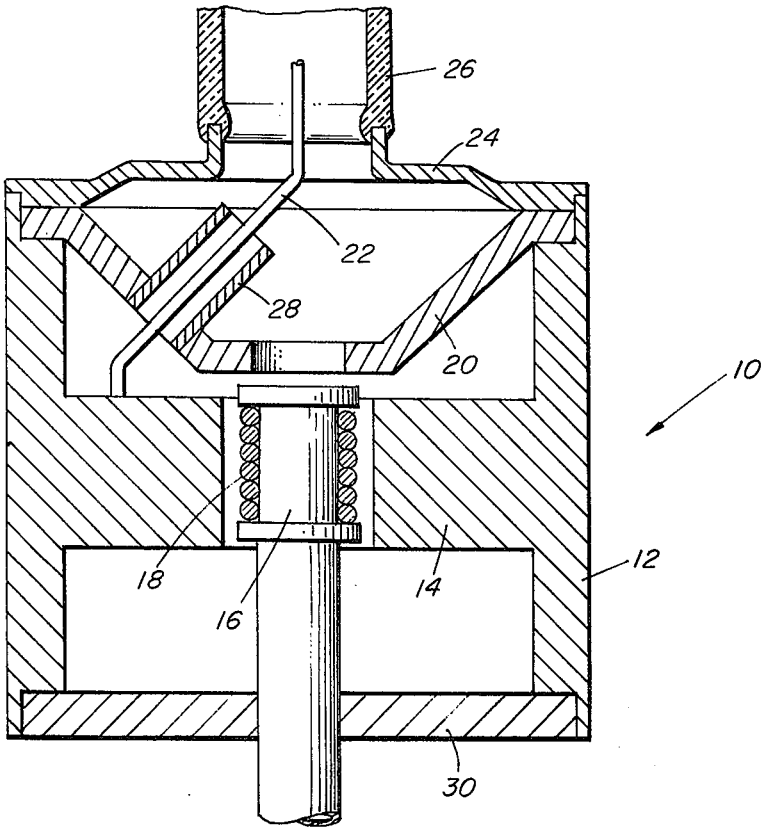
FIG. 1 is a detailed cross-sectional view of a portion of the illustrative embodiment of the invention for suppression of the second harmonic frequency.

Referring to FIG. 1, the embodiment 10 comprises a body member 12 housing the anode member. A plurality of circumferentially disposed vane members 14 define therebetween cavity resonators in the manner well known in the magnetron tube art. Strapping between alternate vane members is generally provided and has not been shown in the drawing for the sake of clarity.

A cathode 16 comprising a coiled emitter 18 is centrally disposed within the anode member. The electrons emitted from the cathode interact with the electric and magnetic fields provided within the anode structure. An inner magnetic pole piece member 20 is provided for concentration of the magnetic field in close proximity of the anode-cathode interaction region. Another magnetic pole piece member is positioned at the opposite end of the device and has not been shown for the sake of clarity.

The output signals are coupled to a utilization load by means of an antenna probe member 22 which is connected at one end to a vane member 14. The envelope is hermetically sealed by means of a plate member 24 and dielectric bulb member 26.

In accordance with the invention, a filter is provided by means of a coaxial cylinder member 28 concentrically disposed about and encircling the antenna member 22. One end of the cylindrical member is secured within an aperture in the inner pole piece member 20. The cylindrical member has an overall length corresponding to a quarter wavelength at the frequency of the energy to be suppressed, illustratively, the second harmonic frequency. The cylindrical member and the antenna form a section of coaxial transmission line. The incoming second harmonic frequency energy and the energy reflected from the outer circuited outer end of the coaxial line form a standing wave having the appearance of a short circuit at the input end of the line adjacent to the inner magnetic pole piece member. The desired signals at the fundamental frequency passes the antenna member without being effected.

The body member is sealed at the cathode end by means of a plate 30 and conventional sealing structures within the cathode tubular member 16 which have not been illustrated in the interest of clarity.

Figure 2:
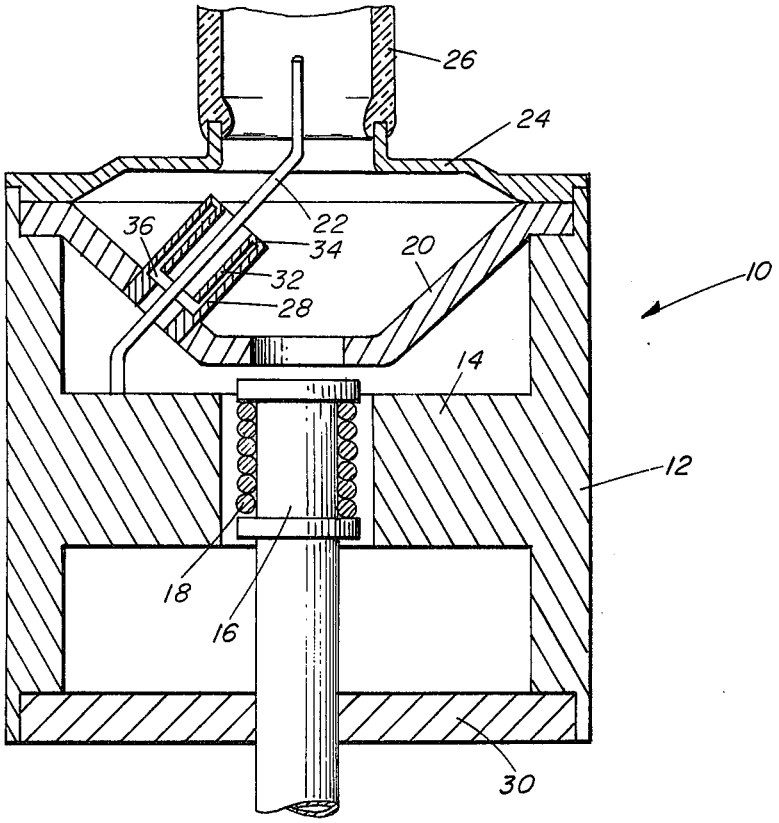
FIG. 2 is a detailed cross-sectional view of a portion of the embodiment for suppression of the second and third harmonic frequencies.

Referring to FIG. 2, structure similar to that shown and described with reference to FIG. 1 has been similarly numbered. In this embodiment, the second harmonic filter 28 is adapted to attenuate still another harmonic frequency, illustratively, the third harmonic. A coaxial member 32 is secured at one end 34 to the walls of cylindrical member 28 to form a reentrant structure. The energy sees an open circuit at point 36 and a short circuit at the wall 34. The energy entering this section through the opening 36 is short circuited at the termination end by wall 34. The third harmonic frequency of the generated energy will, therefore, be effectively suppressed.

There is thus disclosed a unique structure for attenuation of harmonic frequencies of the fundamental frequency of signals generated by the magnetron oscillator. Numerous variations, modifications and alterations will be readily evident to those skilled in the art. It is intended, therefore, that the foregoing illustrative embodiment and detailed description be considered in its broadest aspects.

We claim:

1. A magnetron comprising:

an evacuated envelope;

an anode member comprising a plurality of conductive vane members;

magnetic pole pieces positioned adjacent said anode member;

an output antenna probe member having one end attached to one of said vane members and extending through an aperture in one of said magnetic pole pieces;

a cylindrical conductive member encircling said probe member and attached to said apertured pole piece; and the length of the section of coaxial line formed by said probe and said conductive member having an overall length of approximately one quarter of wavelength of a harmonic frequency of the frequency generated by said magnetron.

2. A magnetron comprising:

an evacuated envelope;

an anode member having an axis comprising a plurality of conductive vane members;

an output antenna probe member having one end attached to one of said vane members;

a cylindrical conductive member disposed within said envelope conductively connected through metallic means to said anode member, encircling said probe member, and spaced therefrom to define therewith a coaxial line filter having its axis positioned at an angle with respect to the axis of said anode member; and said conductive member having an overall length of approximately one quarter of a wavelength of a harmonic frequency of the frequency generated by said magnetron.

3. A magnetron comprising:

an evacuated envelope;

an anode member comprising a plurality of conductive vane members;

an inner magnetic pole piece member disposed in close proximity to said anode member;

an output antenna probe member having one end attached to one of said vane members and extending through an aperture in said magnetic pole piece member;

a cylindrical conductive member having one end electrically connected to said apertured pole piece member and encircling said probe member to define therewith a coaxial line filter; and said conductive member having an overall effective electrical length of approximately one quarter of a wavelength of a harmonic frequency of the frequency generated by said magnetron.

4. A magnetron comprising:

an evacuated envelope;

an anode member comprising a plurality of conductive vane members;

an output antenna probe member having one end attached to one of said vane members;

a first cylindrical conductive member electrically connected to said anode member and encircling said probe member;

said cylindrical conductive member and said probe member forming a quarter wavelength coaxial line filter for suppressing a first predetermined harmonic frequency of the frequency generated by said magnetron; and a second cylindrical conductive member electrically connected to said anode member, disposed coaxially within said first conductive member, and defining a quarter wavelength coaxial line filter for suppressing a second predetermined harmonic frequency of the frequency generated by said magnetron.

* * * * *